US006006575A

United States Patent [19]

Anderson et al.

[11] Patent Number: 6,006,575

[45] Date of Patent: Dec. 28, 1999

[54] REVERSIBLE MANDREL BAR ASSEMBLY

[75] Inventors: William Russell Anderson, Odenville; Miles Gerald Sanderson, Birmingham; Mark Stewart Seeler, Calera, all of Ala.

[73] Assignee: USX Corporation, Pittsburgh, Pa.

[21] Appl. No.: 09/276,325

[22] Filed: Mar. 25, 1999

[51] Int. Cl.[6] ..... B21B 17/10

[52] U.S. Cl. ..... 72/208

[58] Field of Search ..... 72/96, 97, 208, 72/209, 479, 150

[56] References Cited

U.S. PATENT DOCUMENTS

| | | | |
|---|---|---|---|
| 3,688,540 | 9/1972 | Russel | 72/208 |
| 3,845,649 | 11/1974 | Gerretz et al. | 72/189 |
| 4,015,460 | 4/1977 | Moore, Jr. | 72/97 |
| 4,149,396 | 4/1979 | Meuer et al. | 72/97 |
| 4,318,294 | 3/1982 | Yoshiwara et al. | 72/370 |
| 4,406,143 | 9/1983 | Patula | 72/209 |
| 4,483,638 | 11/1984 | Marie et al. | 20/403 |
| 4,487,049 | 12/1984 | Danchenko et al. | 72/208 |
| 4,606,208 | 8/1986 | Williamson | 72/133 |
| 4,724,697 | 2/1988 | Hein et al. | 72/208 |
| 5,536,050 | 7/1996 | McDermott et al. | 285/286 |
| 5,778,718 | 7/1998 | Stinnertz et al. | 72/214 |

FOREIGN PATENT DOCUMENTS 829227 5/1981 U.S.S.R. .

*Primary Examiner*—Rodney Butler
*Attorney, Agent, or Firm*—William F. Riesmeyer

[57] ABSTRACT

The present invention is of a mandrel bar assembly for a seamless pipe mill. The assembly includes a pair of tooling sections each having a tapered end, a reduced diameter portion axially inward of the tapered end adapted to be gripped by a retaining means of the mill, and a working portion adjacent the reduced diameter portion extending from the reduced diameter portion to the end opposite the tapered portion. The assembly includes a coupling for connecting the tooling sections together end-to-end with the tapered ends facing oppositely outward therefrom. An adapter is provided to cover the reduced diameter portion and provide a working surface thereon of one tooling section that is to be positioned as the lead end into the mill. When one tooling section wears the adapter can be removed and installed on the other tooling section, and the assembly is reversed end-to-end to use the other tooling section as the lead end, extending the useful life of the assembly.

2 Claims, 2 Drawing Sheets

REVERSIBLE MANDREL BAR ASSEMBLY

TECHNICAL FIELD

This invention relates to a mandrel bar assembly for a pipe mill, and particularly to a reversible mandrel bar assembly for a seamless pipe mill.

BACKGROUND ART

In the manufacture of seamless steel pipe, mandrel bars are used to support the interior surface of a hollow article that is being rolled into pipe. In a retained mandrel multi-pass mill, the conventional tooling mandrel assembly comprises a tooling section, an extension and a tailpiece. The tooling section includes a tapered lead end for guiding and a cylindrical body which supports the interior surface of the article as it is being rolled. The extension is not designed to have steel rolled on it. It provides additional length so that the tooling section may be fully utilized throughout the entire working length during rolling. The tailpiece is designed to drop into a socket so the mandrel can be held back or "retained" during the rolling operation. The three pieces of the tooling mandrel assembly are connected together by buttress threaded ends. The use of these threaded joints results in variations in the length of the assembly after the sections are connected. Thus it is necessary to insert a washer spacer between the sections to achieve the proper fit. To determine the size of spacer required, the thread is tightened to a predetermined torque and the gap is measured with a gauge. The thread is then unscrewed and the spacer is added. The joint is again turned until the final desired torque is achieved. The spacer helps eliminate premature breaking of the threaded member from non-axial loading of the tooling mandrel assembly. Considerable time is required to construct a tooling mandrel assembly and it is very expensive. When the tooling section wears, it is also costly to break down the assembly and construct a new one.

U.S. Pat. No. 4,487,049 to Danchenko et al, discloses a working mandrel for a multi-stand continuous seamless pipe rolling mill. The working mandrel comprises one or more pieces each having a socket on the leading end for loosely receiving a compression bar or a projection on the trailing end of another like piece of the working mandrel. The working mandrel pieces travel through the roll stands with the hollow shell as it is rolled. After exit from the rolls of the last stand the pieces easily separate from each other and the compression bar. The working mandrel pieces are then transferred to a mandrel preparation line. This saves auxiliary operations formerly required for retraction of the bar back through the roll stands and then transfer of the mandrel to a cooling and lubricating preparation line. The reference does not disclose a reversible mandrel bar assembly. An abstract of a Russian patent to the same assignee as the U.S. Patent just mentioned, discloses reverse movement of a mandrel rod after deformation of the shell. An abstract of another Russian patent SU 829 227, also to the same assignee just mentioned discloses reverse movement of a mandrel bar in a non-continuous tube rolling process. Neither abstract discloses a mandrel bar assembly having tooling sections which may be turned end-to-end to extend the useful life of the mandrel bar assembly.

U.S. Pat. No. 4,318,294 to Yoshiwara et al, discloses a mandrel which is used in a billet piercing process and in a subsequent rotary rolling process. The mandrel remains inserted in the shell formed in the piercing process so as to support the shell in the rotary rolling process. The mandrel is not reversible.

U.S. Pat. No. 4,406,143, to Patula, discloses a return pass practice for a plug mill in a seamless pipe manufacturing operation. The mandrel is not reversible. Various plug designs for seamless plug mills are disclosed in U.S. Pat. No. 4,015,460, to Moore, Jr., and U.S. Pat. No. 4,483,638, to Marie, et al. These references do not disclose a reversible mandrel bar assembly.

U.S. Pat. No. 3,688,540, to Russel, discloses a tapered mandrel for a reciprocatingly driven tube rolling mill.

Various other miscellaneous patents for pipe and tube production are as follows: U.S. Pat. No. 5,778,718; U.S. Pat. No. 4,606,208; and U.S. Pat. No. 3,845,649.

DISCLOSURE OF INVENTION

The present invention is of a reversible mandrel bar assembly for supporting a hollow article during rolling in a pipe rolling mill. The assembly includes a pair of elongated cylindrical tooling sections each having a tapered end portion, a portion of reduced diameter axially inward of the tapered end, and a working portion adjacent the axially inner end of the reduced diameter portion and extending to the end remote from the tapered end, said working portion having a diameter for support of the interior of the hollow article to be rolled. The elongated tooling sections are adapted to be connected end-to-end. Preferably the end remote from the tapered end of each section has an internally threaded bore and a threaded coupling pin is provided to connect the sections together. An adapter is provided for attachment to one of the reduced diameter portions to provide a continuous working surface adjacent to one end of the assembly. The adapter preferably comprises a pair of semi-circular jacket sections having an outer radius equal to, or slightly less than, the radius of the working portion and means for securing the jacket sections together on the reduced diameter portion. The reduced diameter portions are adapted to be gripped by a device for retaining the mandrel in position during the rolling operation. The tapered end portion adjacent the adapter serves as the leading end during insertion into the article. When the working surface adjacent the leading end becomes worn, the mandrel tooling assembly can be turned end-to-end and the adapter can be removed from the previous leading end and attached to the new leading end of the assembly. The tooling mandrel assembly of this invention saves considerable make-up time and expense that was required for prior art mandrel tooling assemblies.

MODES FOR CARRYING OUT THE INVENTION

Figure 1:
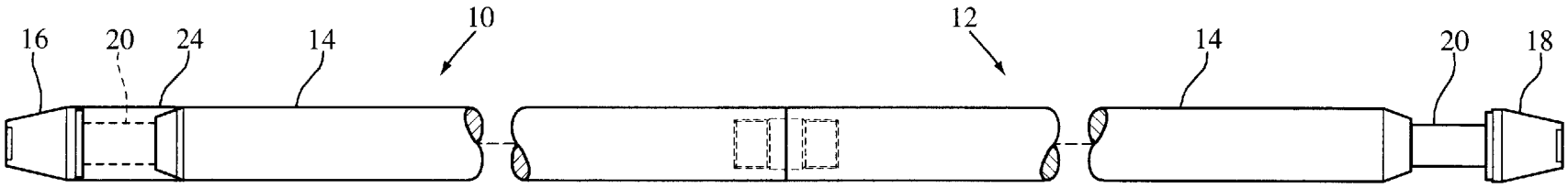
FIG. 1 is side elevation view of the mandrel tooling assembly of this invention.
Figure 2:
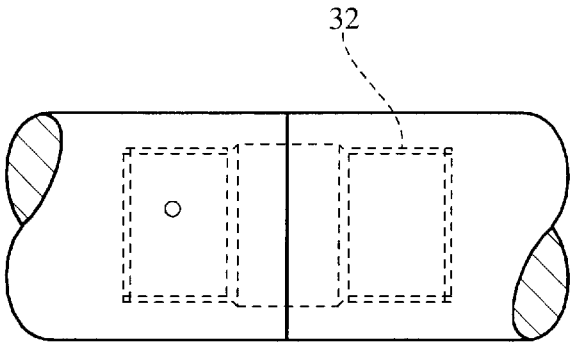
FIG. 2 is an enlarged view of a prior art coupling pin for connecting the tooling sections of the assembly of FIG. 1 together.
Figure 4:
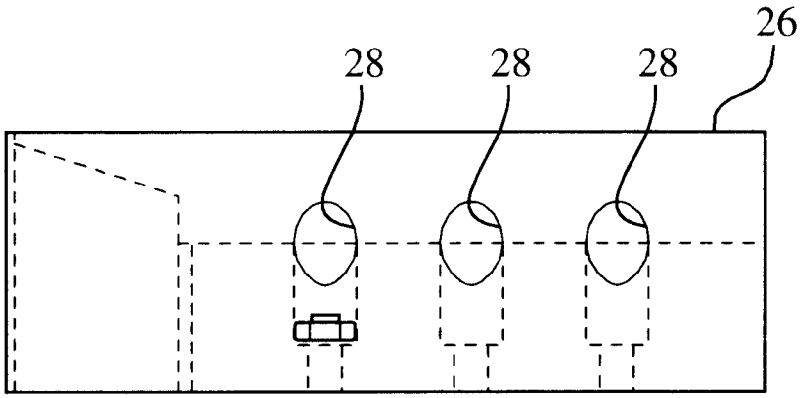
FIG. 4 is a side elevation view of the jacket section of FIG. 3.
Figure 3:
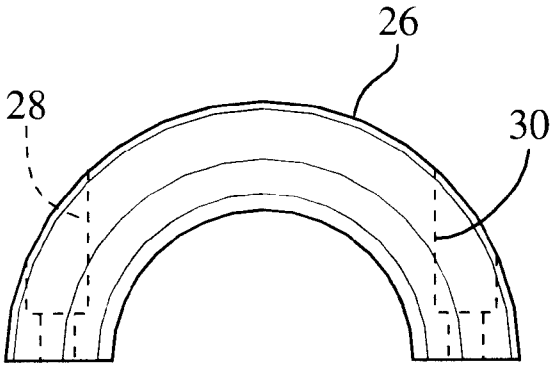
FIG. 3 is an end view of one of the jacket sections of an adapter for attachment to one of the reduced diameter portions of the assembly of FIG. 1.

Referring to FIG. 1 the mandrel bar assembly of the present invention includes elongated cylindrical tooling sections 10 and 12 each having an outer working surface 14 of suitable diameter for support of a hollow article during a rolling operation for the manufacture of seamless pipe. Each tooling section has a tapered end portion 16 and 18, respectively. A reduced diameter portion 20 and 22 is located axially inward of the tapered end of each tooling section adjacent the working surface. Each reduced diameter portion is adapted to be gripped by a mandrel retaining mechanism of the mill (not shown). An adapter 24 is provided for attachment to one of the reduced diameter portions adjacent the tapered end to be positioned as the lead end for insertion in the article to be rolled. The adapter preferably comprises a pair of semi-cylindrical jacket sections, one of which is shown at 26 in FIGS. 3 and 4. Each jacket section has counterbored slots 28 and 30 for receiving bolts and nuts to secure the sections together. The tooling sections are connected end-to-end, preferably by coupling pin 32 (FIG. 2) of the type disclosed in U.S. Pat. No. 5,536,050, the specification of which is incorporated by reference herein.

Thus, the invention eliminates the need for non-usable extension sections in the mandrel bar assembly by the provision of identical tooling sections, each having a reduced diameter portion for engagement by retaining means and an adapter for providing a working surface the reduced diameter portion leading into the mill. By incorporating the reduced diameter portion into the tooling section and eliminating a separate tail section, the length variability associated with the tailpiece connection by buttress threads is also eliminated. The mandrel bar assembly of the present invention decreases make-up time and permits reversal of the assembly end-to-end when one of the tooling sections becomes worn so that the other tooling section may be used. To do this, the adapter is removed from the previously used tooling section and is installed on the other section which when the assembly is reversed end-to-end becomes the lead section into the mill. This extends the life of the tooling mandrel and increases the quality of the interior of pipe produced by the use of prime tooling surfaces over a greater portion of the mandrel life.

Make-up of the assembly involves connecting two tooling sections end-to-end utilizing coupling pin 32. Once hand tightened, the assembly is torqued to a predetermined value so as to elongate coupling pin 32 to a defined length. When torqued, adapter 24 is installed on the lead end of the assembly closest to the mill roll stands. The assembly installed in the mill and gripped by the retaining means at the reduced diameter portion on the trailing end. The assembly is then ready for use in the production of pipe.

Industrial Applicability

The invention is useful in the production of seamless steel pipe.

What is claimed is:

1. A tooling mandrel assembly for use in a seamless pipe mill, comprising:

a pair of tooling sections each having a tapered end portion, a reduced diameter portion axially inward of the tapered end portion, and a working portion having an axially uniform diameter corresponding to the diameter of an axially inner end of the tapered portion, a coupling for connecting the tooling sections together end-to-end with the tapered ends projecting outwardly therefrom, and an adapter for attachment to the reduced diameter portion of an end of the assembly to be positioned as the lead end into the pipe mill, said adapter having an outer surface of diameter substantially the same as, or slightly less than, a working surface of the tooling section, whereby said tooling mandrel assembly is reversible end-to-end in order to extend the usable life of the assembly by the use of one of the tooling sections and then the other when the first becomes unusable due to wear on the working surface thereof.

2. The assembly of claim 1 wherein said coupling comprises a pin having opposite externally threaded ends and the end of each tooling section remote from the tapered end thereof has an internally threaded bore for receiving a threaded end of said coupling pin therein.

* * * * *